US011268468B2

(12) United States Patent
Tanaka et al.

(10) Patent No.: US 11,268,468 B2
(45) Date of Patent: Mar. 8, 2022

(54) AIR-FUEL RATIO CONTROL DEVICE

(71) Applicant: DENSO CORPORATION, Kariya (JP)

(72) Inventors: Makoto Tanaka, Kariya (JP); Masatake Wada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/062,953

(22) Filed: Oct. 5, 2020

(65) Prior Publication Data

US 2021/0017924 A1 Jan. 21, 2021

Related U.S. Application Data

(63) Continuation of application No. PCT/JP2019/014105, filed on Mar. 29, 2019.

(30) Foreign Application Priority Data

Apr. 9, 2018 (JP) ..... JP2018-074959

(51) Int. Cl.
*F02D 41/14* (2006.01)

(52) U.S. Cl.
CPC ..... *F02D 41/1454* (2013.01); *F02D 41/1461* (2013.01)

(58) Field of Classification Search
CPC ..... F02D 41/1454; F02D 41/1461; F02D 2200/1012; F02D 41/1463; F02D 41/1498; F02D 41/1475
See application file for complete search history.

(56) References Cited

U.S. PATENT DOCUMENTS 5,592,919 A 1/1997 Morikawa
5,636,614 A 6/1997 Morikawa
5,660,157 A * 8/1997 Minowa ..... B60W 30/18 123/344
8,943,804 B2 * 2/2015 Schreurs ..... F01N 3/035 60/285
9,273,640 B2 * 3/2016 Shinoda ..... F02D 19/0636
9,464,558 B2 * 10/2016 Tobben ..... F01N 3/2066
(Continued)

FOREIGN PATENT DOCUMENTS

JP 11-229934 8/1999
JP 2010-48184 3/2010
(Continued)

*Primary Examiner* — Joseph J Dallo
(74) *Attorney, Agent, or Firm* — Nixon & Vanderhye P.C.

(57) ABSTRACT

An air-fuel ratio control device sets a target air-fuel ratio and performs an air-fuel ratio control based on the target air-fuel ratio for an engine of a spark ignition type. The air-fuel ratio control device includes a lean combustion determination unit that determines whether a lean combustion is performed in the engine at the target air-fuel ratio, the target air-fuel ratio being set leaner than the theoretical air-fuel ratio; a target NOx setting unit that sets a target NOx concentration according to an operation state of the engine; an acquisition unit that acquires an actual NOx concentration detected by using a NOx concentration detection unit in an exhaust passage of the engine; and a correction unit that corrects the target air-fuel ratio based on the target NOx concentration and the actual NOx concentration when determination is made that lean combustion is performed.

20 Claims, 5 Drawing Sheets

(56) References Cited

U.S. PATENT DOCUMENTS

| | | | | |
|---|---|---|---|---|
| 9,506,414 | B2 * | 11/2016 | Melby | F02D 41/064 |
| 9,624,861 | B2 * | 4/2017 | Weber | F02D 41/1458 |
| 9,689,354 | B1 * | 6/2017 | Beresford-Knox | B01J 23/40 |
| 2005/0072139 | A1 * | 4/2005 | Kato | F02D 41/1441 60/285 |
| 2005/0076635 | A1 * | 4/2005 | Suyama | F01N 9/005 60/276 |
| 2007/0006575 | A1 * | 1/2007 | Mizuguchi | F01N 3/0871 60/286 |
| 2008/0148712 | A1 * | 6/2008 | Wada | F01N 9/00 60/285 |
| 2009/0099753 | A1 * | 4/2009 | Kaneko | F02D 41/2454 701/103 |
| 2011/0077840 | A1 * | 3/2011 | Nishigaki | F02D 41/1495 701/104 |
| 2013/0074817 | A1 * | 3/2013 | Fisher | F02D 41/266 123/674 |
| 2013/0151124 | A1 * | 6/2013 | Seiberlich | F02D 41/005 701/108 |
| 2013/0325296 | A1 * | 12/2013 | Koshi | F02D 41/1454 701/104 |
| 2014/0041367 | A1 * | 2/2014 | Balthes | F02M 26/10 60/274 |
| 2016/0290307 | A1 * | 10/2016 | Urano | F02D 37/02 |
| 2016/0312731 | A1 * | 10/2016 | Tsuchiya | F02D 41/3094 |

FOREIGN PATENT DOCUMENTS

| | | |
|---|---|---|
| JP | 2010-285908 | 12/2010 |
| JP | 2011-220159 | 11/2011 |
| JP | 2017-166356 | 9/2017 |

* cited by examiner

AIR-FUEL RATIO CONTROL DEVICE

CROSS REFERENCE TO RELATED APPLICATION

The present application is a continuation application of International Patent Application No. PCT/JP2019/014105 filed on Mar. 29, 2019, which designated the U.S. and claims the benefit of priority from Japanese Patent Application No. 2018-074959 filed on Apr. 9, 2018. The entire disclosures of all of the above applications are incorporated herein by reference.

TECHNICAL FIELD

The present disclosure relates to an air-fuel ratio control device for an internal combustion engine.

BACKGROUND

A conventional lean-burn engine is configured to burn lean air-fuel mixture.

SUMMARY

According to an aspect of the present disclosure, an air-fuel ratio control device is configured to set a target air-fuel ratio and to perform an air-fuel ratio control based on the target air-fuel ratio in a spark ignition type engine.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
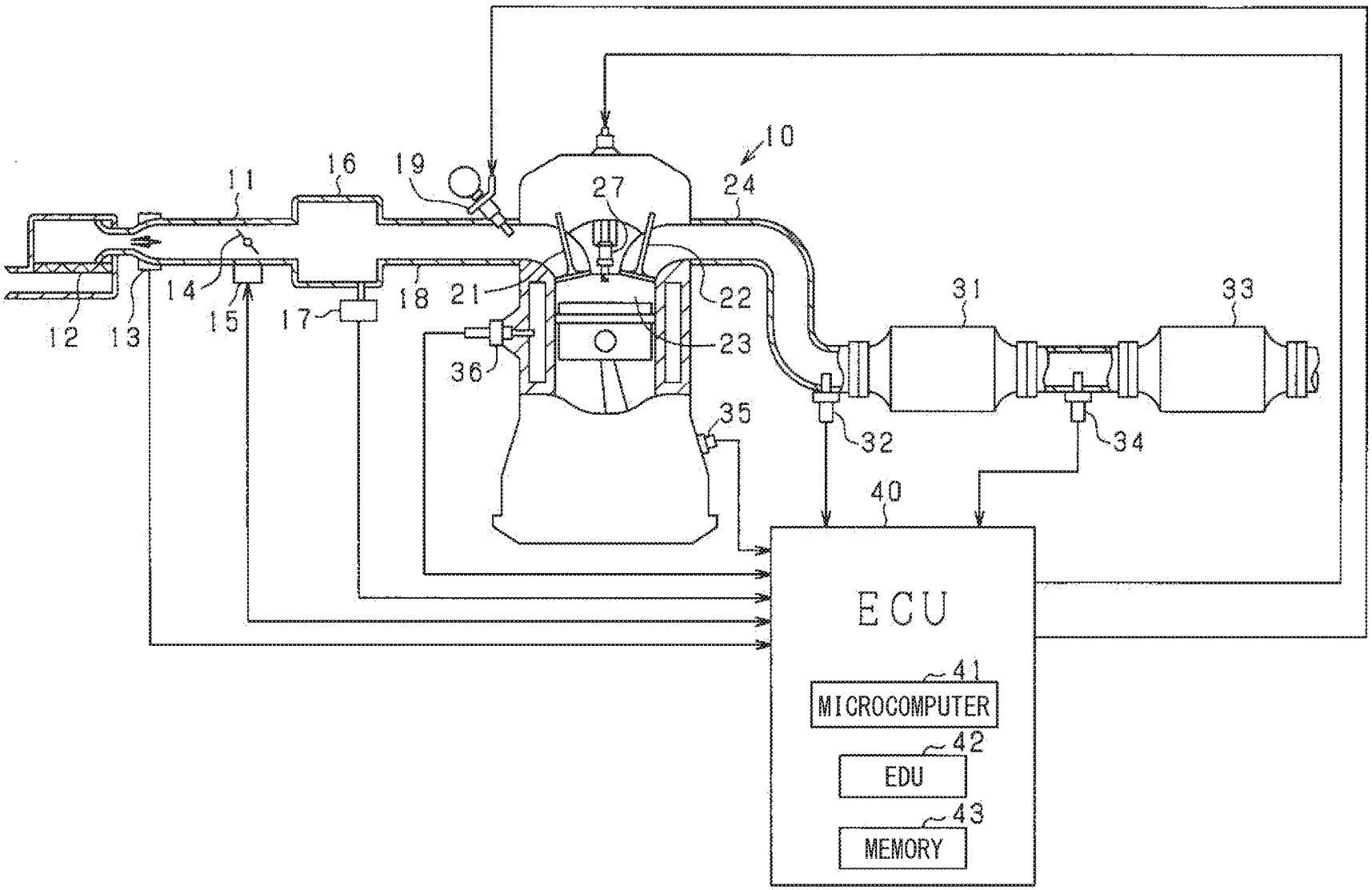
FIG. 1 is a diagram illustrating a schematic configuration of an engine control system.

As follows, examples of the present disclosure will be discussed.

According to an example of the present disclosure, an internal combustion engine configured to burn lean air-fuel mixture, which is leaner than that of a stoichiometric air-fuel ratio, enables to reduce emission of NOx by controlling a lean degree of the air-fuel ratio of the air-fuel mixture. However, it is assumable that when the air-fuel ratio exceeds a limit of the lean degree, misfiring could occur, and combustion fluctuation could increase. This could cause decrease in drivability and is not preferable.

According to an example of the present disclosure, an assumable configuration may be employable to detect a combustion fluctuation from a fluctuation in engine rotation speed and torque and to perform an air-fuel ratio control based on the detection result, thereby not to exceed the lean limit for suppressing deterioration of a combustion state of an engine. However, a concern arises in this assumable configuration, which performs the air-fuel ratio control based on the combustion fluctuation as described above, that a combustion state of the internal combustion engine cannot be detected until the state clearly deteriorates due to increasing of the combustion fluctuation determination threshold. Consequently, the configuration may make an erroneous detection that the combustion state has deteriorated even in a combustion state that is normal due to setting of the judgment threshold to a small value. As described above, there is still room for improvement in the air-fuel ratio control in order to stabilize combustion while reducing NOx emissions.

According to an example of the present disclosure, an air-fuel ratio control device is configured to set a target air-fuel ratio and to perform an air-fuel ratio control based on the target air-fuel ratio in a spark ignition type engine. The air-fuel ratio control device includes a lean combustion determination unit configured to determine whether lean combustion is performed in the engine based on the target air-fuel ratio, the target air-fuel ratio being set on a lean side of the theoretical air-fuel ratio. The air-fuel ratio control device includes a lean combustion determination unit configured to determine whether lean combustion is performed in the engine based on the target air-fuel ratio. The air-fuel ratio control device includes a target NOx setting unit configured to set a target NOx concentration according to the operation state of the engine. The air-fuel ratio control device includes an acquisition unit configured to acquire an actual NOx concentration detected by using a NOx concentration detection unit in an exhaust passage of the engine. The air-fuel ratio control device includes a correction unit configured to correct the target air-fuel ratio based on the target NOx concentration and the actual NOx concentration when determination is made that the lean combustion is being performed.

When lean combustion is performed in the engine, as the combustion temperature becomes higher, the NOx emission tends to increase. In addition, as the combustion temperature decreases, the NOx emission tends to decrease. It is considered that the combustion state of the engine can be grasped according to the NOx emission amount. For example, when the NOx emission amount is large, it can be estimated that the combustion temperature is high, that is, the combustion state is good. When the NOx emission amount is small, it can be estimated that the combustion temperature is low, that is, the combustion state is not good.

In the present disclosure, focusing on the above relationship, the target air-fuel ratio is corrected based on the target NOx concentration and the actual NOx concentration when it is determined that lean combustion is being performed. In this way, the configuration enables to perform the air-fuel ratio control appropriately in order to stabilize the combustion while optimizing the NOx emission amount from the engine.

Hereinafter, an air-fuel ratio control device according to an embodiment of the present disclosure will be described with reference to the drawings.

In this embodiment, an engine control system is constructed for a spark ignition type on-vehicle multi-cylinder gasoline engine which is an internal combustion engine. In the control system, an electronic control unit (hereinafter referred to as "ECU") is used as a center to implement a control for a fuel injection amount, a control for an ignition timing, and the like. First, a schematic configuration of an engine control system will be described with reference to FIG. 1.

An air cleaner 12 is provided at the most upstream part of an intake pipe 11 of an internal combustion engine 10. An airflow meter 13 is provided downstream of the air cleaner 12 for detecting an intake air amount (intake air flow rate). A throttle valve 14 is provided on a downstream side of the airflow meter 13. An opening degree of the throttle valve 14 is adjusted by a throttle actuator 15 such as a DC motor. The opening (throttle opening degree) of the throttle valve 14 is detected by a throttle opening sensor incorporated in the throttle actuator 15. A surge tank 16 is provided on the downstream side of the throttle valve 14, and an intake pipe pressure sensor 17 for detecting an intake pipe pressure is provided in the surge tank 16. In addition, the surge tank 16 is connected with an intake manifold 18 that draws air into each cylinder of the engine 10. A fuel injection valve 19 is attached near the intake port of each cylinder of the intake manifold 18. The fuel injection valve 19 is electromagnetically driven for injecting and supplying fuel.

An intake valve 21 and an exhaust valve 22 are provided to the intake port and the exhaust port of the engine 10, respectively. Mixture of air and fuel is introduced into a combustion chamber 23 by opening of the intake valve 21. Exhaust gas after combustion is discharged to an exhaust pipe 24 by opening of the exhaust valve 22. A spark plug 27 is attached to a cylinder head of the engine 10 for each cylinder. High voltage is applied to the spark plug 27 at a desired ignition timing through an ignition device (igniter, not shown) including an ignition coil and the like. By applying this high voltage, opposing electrodes of each spark plug 27 generates a spark discharge therebetween, and the air-fuel mixture introduced into the combustion chamber 23 is ignited and used for combustion.

A three-way catalyst 31 and a NOx catalyst 33 are provided as an exhaust purification device in the exhaust pipe 24 to purify CO, HC, NOx, and the like in the exhaust gas. The three-way catalyst 31 purifies three components of HC, CO and NOx in the exhaust gas around a stoichiometric air-fuel ratio. The NOx catalyst 33 is a NOx occlusion reduction type catalyst. The NOx catalyst 33 stores NOx in exhaust gas during combustion at a lean air-fuel ratio. The NOx catalyst 33 reacts stored NOx with rich components (CO, HC, and the like) to purify the rich components during combustion at a rich air-fuel ratio. An air-fuel ratio sensor 32 (specifically, an A/F sensor) is provided on the upstream side of the three-way catalyst 31. A NOx sensor 34 is provided between the three-way catalyst 31 and the NOx catalyst 33.

In addition, a cooling water temperature sensor 36 and a crank angle sensor 35 are provided to the cylinder block of the engine 10. The cooling water temperature sensor 36 detects a cooling water temperature. The crank angle sensor 35 outputs a rectangular crank angle signal for each predetermined crank angle of the engine 10 (for example, at a 30° C. cycle).

The detection signals of the various sensors described above are input to an ECU 40 that controls the engine. The ECU 40 is an electronic control unit mainly including a microcomputer and performs various controls of the engine 10 with the use of the detection signals detected by the various sensors. The ECU 40 includes a microcomputer 41 for engine control, an electronic drive unit (EDU 42) for driving the injector, and a memory 43 for data backup. The microcomputer 41 calculates a required injection amount of fuel in accordance with engine operation state such as the engine speed and the engine load. The microcomputer 41 generates an injection pulse from an injection time calculated based on this required injection amount and outputs the injection pulse to an EDU 42. The EDU 42 drives and opens the fuel injection valve 19 in accordance with the injection pulse to inject fuel by the required injection amount. The ECU 40 corresponds to the an air-fuel ratio control device. The memory 43 is a storage unit such as a backup RAM or an EEPROM that is configured to retain stored contents even after the ignition switch turned off.

The microcomputer 41 has a function to perform an air-fuel ratio feedback control. The microcomputer 41 controls the fuel injection amount based on a deviation between a target air-fuel ratio and an actual air-fuel ratio detected by the air-fuel ratio sensor 32, thereby to perform the air-fuel ratio feedback control. In this embodiment, as the air-fuel ratio feedback control, the target air-fuel ratio is set to be leaner than the stoichiometric air-fuel ratio, and a lean combustion control is performed based on the lean target air-fuel ratio. For example, the microcomputer 41 determines whether lean combustion can be performed according to the operation state of the engine 10. When the combustion can be performed, the microcomputer 41 sets an engine combustion mode to a lean combustion mode and performs the air-fuel ratio feedback control based on the target air-fuel ratio that is the lean value.

When the lean combustion is performed in the engine 10, as the combustion temperature becomes higher, the NOx emission tends to increase, and as the combustion temperature becomes lower, the NOx emission tends to reduce. Therefore, it is conceivable that the combustion state of the engine 10 can be grasped according to the NOx emission amount. For example, when the NOx emission amount is large, it can be estimated that the combustion temperature is high, that is, the combustion state is good. When the NOx emission amount is small, the combustion temperature is estimated to be low, that is, the combustion state is not good.

Therefore, in this embodiment, focusing on the above relationship, the target air-fuel ratio is corrected based on the target NOx concentration and the actual NOx concentration when it is determined that lean combustion is being performed. Herein, the target NOx concentration may be set according to the operation state of the engine 10. Specifically, the target NOx concentration may be set based on the engine speed and the engine load (or required torque). The actual NOx concentration is the actual NOx concentration in exhaust gas discharged from the engine 10 and is computed from the detection value of the NOx sensor 34.

Figure 2:
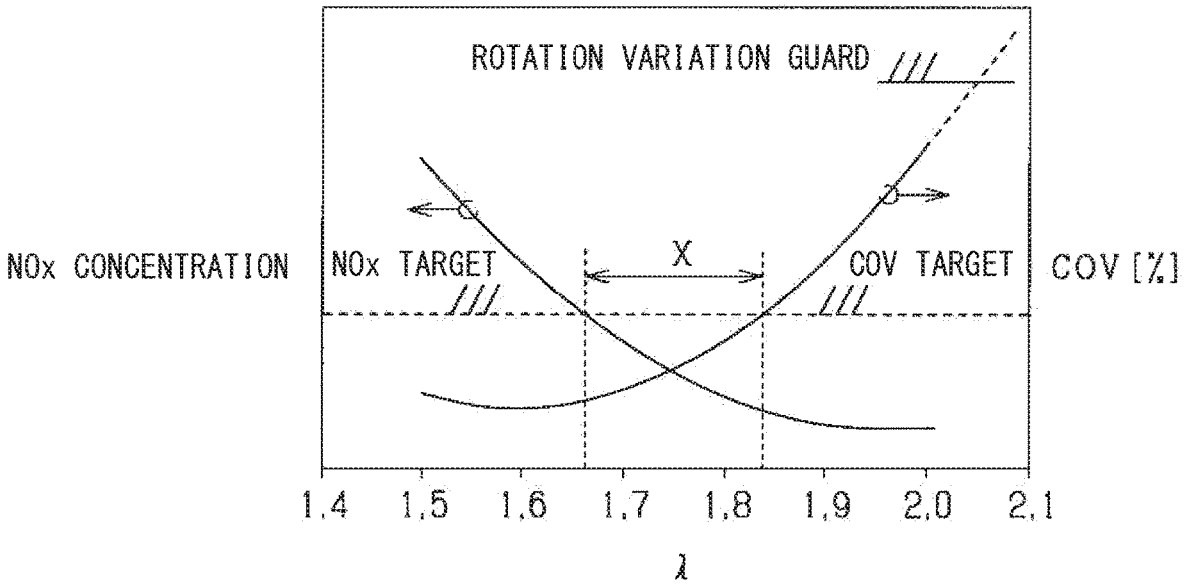
FIG. 2 is a graph showing a relationship between an excess air ratio A, a NOx concentration and a combustion stability index COV in a lean range of an air-fuel ratio.

FIG. 2 shows a relationship between an excess air ratio A (air-fuel ratio) and the NOx concentration and further shows a relationship between the excess air ratio λ and a combustion stability index COV (coefficient of variation) of the engine 10 in a lean range of the air-fuel ratio. The combustion stability index COV is an index representing a combustion stability. As the combustion stability index COV becomes large, the combustion becomes more unstable.

As shown in FIG. 2, the NOx concentration tends to decrease as the excess air ratio λ increases, that is, as the lean degree increases. The combustion stability index COV tends to increase as the excess air ratio λ increases, that is, as the lean degree increases. In this case, it is desirable that the target air-fuel ratio (excess air ratio λ) during the lean combustion is set within a range of X in the drawing in consideration of the upper limit value of the NOx concentration and the upper limit value of the combustion stability index COV. Specifically, a rich side limit value of the air-fuel ratio, which is determined by the NOx allowable limit, and a lean side limit value of the air-fuel ratio, which is determined by the allowable limit of combustion stability, arise in the lean range of the air-fuel ratio. The range X is between the rich side limit value and the lean side limit value. As the lean degree of the air-fuel ratio increases, a rotation variation of the engine 10 increases. Therefore, a rotation variation limit value is set.

In the lean burn mode, the microcomputer 41 corrects the target air-fuel ratio such that the lean degree increases when the actual NOx concentration is higher than the target NOx concentration. In this way, the NOx concentration is decreased. Further, the microcomputer 41 corrects the target air-fuel ratio such that the lean degree becomes smaller when the actual NOx concentration is lower than the target NOx concentration. In this way, the combustion stability is enhanced.

In this embodiment, a configuration is employed that computes the target air-fuel ratio correction value $\Delta\lambda$ based on the actual NOx concentration and the target NOx concentration. The correction value $\Delta\lambda$ is stored in the memory 43 and is updated as appropriate. In short, a process to compute the correction value $\Delta\lambda$ is performed as a learning process, and the correction value $\Delta\lambda$ is stored as a learning value in the memory 43. It is noted that, the correction value $\Delta\lambda$ may not be computed as the learning process. In this case, the correction value $\Delta\lambda$ is deleted when the ignition switch of the vehicle is turned off, and the correction value $\Delta\lambda$ is computed again after the ignition switch is turned on.

Next, the processing for calculating the correction value of the target air-fuel ratio in the lean combustion mode will be described with reference to the flowchart of FIG. 3. This computation process is regularly performed by the microcomputer 41.

Figure 3:
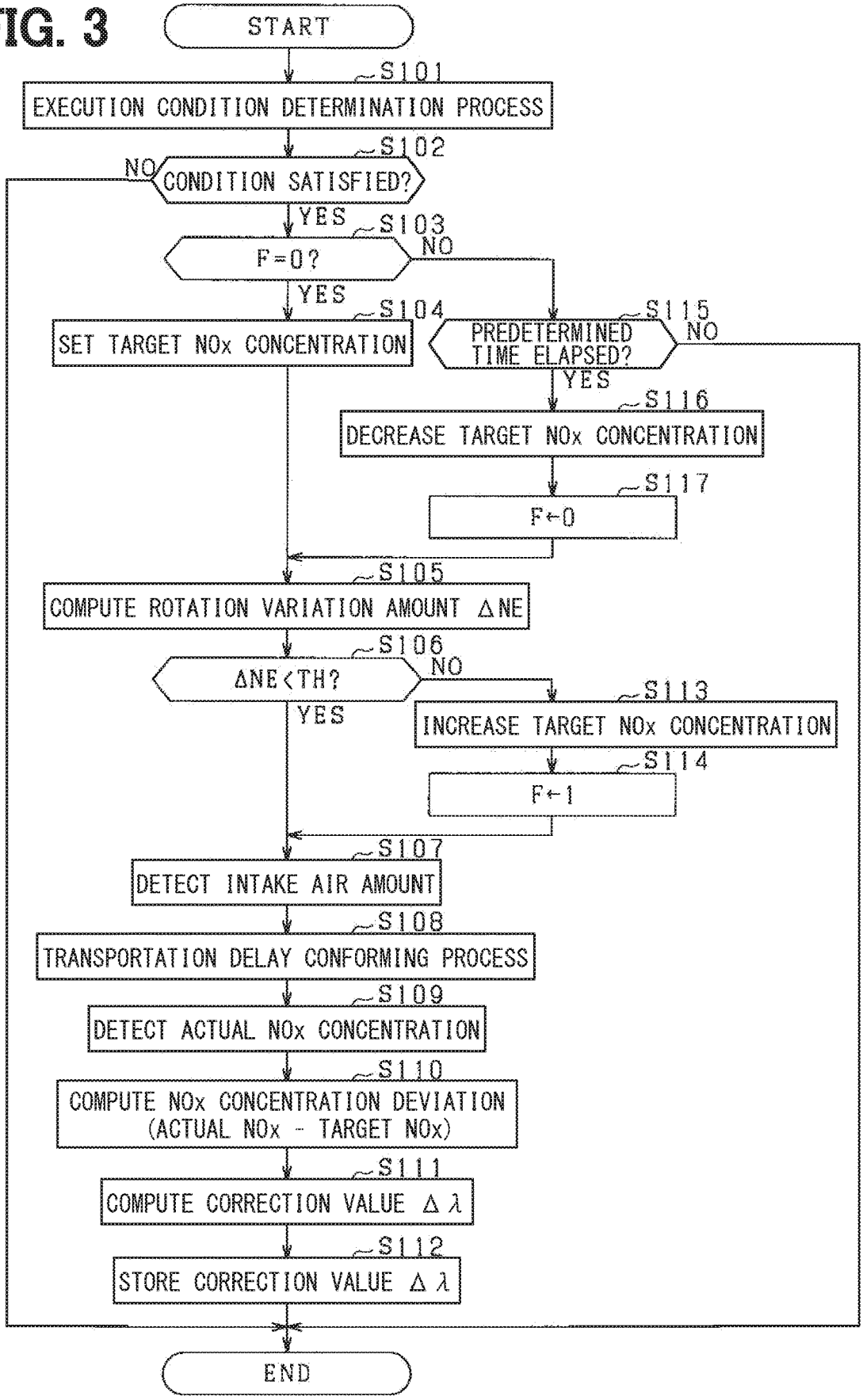
FIG. 3 is a flowchart showing a computation processing.

In FIG. 3, in step S101, an execution condition determination process is executed to determine whether or not an execution condition to compute the target air-fuel ratio correction value is satisfied. In the present embodiment, the microcomputer 41 determines whether each of the following first to fifth conditions is satisfied.

The microcomputer 41 first determines, as a first condition, various learnings that affect the combustion state of the engine 10 have been completed. Specifically, determinations are made whether learning concerning driving of the fuel injection valve 19 (for example, valve closing timing and valve opening timing), learning concerning a reference position of a variable valve mechanism (for example, VCT or VVL), and learning concerning EGR valve reference position for an external EGR function have been completed. That is, when various learnings that affect the combustion state of the engine 10 have not been completed, it is concerned that NOx emissions and combustion stability vary and that the correction value of the target air-fuel ratio cannot be computed properly due to that effect. Therefore, the condition is not satisfied.

The microcomputer 41 determines, as a second condition, whether the engine 10 is not in a transient operation state. Specifically, determination is made whether a variation in the required torque is within a predetermined range for a predetermined period. Specifically, during the transient operation and immediately after the transient operation, it is considered that the NOx emission amount is not stable and that the possibility that the correction value of the target air-fuel ratio cannot be calculated properly increases. It is noted that, the determination whether the operation state is in the transient operation state may be made based on a parameter that has a correlation with the operation state of the engine 10 such as the engine speed, the engine load, the intake air flow rate, the intake pressure, the fuel injection amount, the vehicle speed, acceleration, and the like. The determination may be made based on the change in the NOx amount of exhaust gas.

Further, the microcomputer 41 determines, as a third condition, whether both the air-fuel ratio sensor 32 and the NOx sensor 34 are in an active state. The microcomputer 41 determines, as a fourth condition, whether various failure histories do not exist. The microcomputer 41 determines, as a fifth condition, whether the lean operation is being performed (that is, the state excluding stoichiometry and rich purge).

Subsequently, in the following step S102, determination is made based on the determination result of step S101 whether or not the execution condition is satisfied, that is, whether or not all of the first to fifth conditions are satisfied. In this case, when the execution condition is satisfied, the process proceeds to the subsequent step S103, and when the execution condition is not satisfied, the present process ends as it is.

In step S103, determination is made whether a NOx concentration increasing flag F is 0. The initial state of the NOx concentration increasing flag F is F=0, and herein, description will be made assuming that F=0. When F=0, the process proceeds to step S104.

In step S104, the target NOx concentration is set based on the operation state of the engine 10. Specifically, the target NOx concentration is set based on the engine rotation speed and the required torque. It is noted that, The target NOx concentration may be set based on an engine cooling water temperature, the operation state of the EGR valve, the operating state of a movable drive valve, and the like, in addition to the engine speed and the required torque.

In the following step S105, a rotation variation amount $\Delta NE$ of the engine 10 is computed. Specifically, the rotation variation amount $\Delta NE$ is computed based on a variation in the engine rotation speed, which is detected by the crank angle sensor 35, in a predetermined time. The method to compute the rotation variation amount $\Delta NE$ may employ various ways. For example, in a configuration, in which the engine 10 is equipped with an in-cylinder pressure sensor, the rotation variation amount $\Delta NE$ may be computed based on a variation in the in-cylinder pressure among combustions.

Subsequently, in step S106, determination is made whether or not the rotation variation amount $\Delta NE$ is less than a predetermined threshold TH. For example, when the combustion state of the engine 10 deteriorates, it is conceivable that the rotation variation of the engine 10 increases and the rotation variation amount $\Delta NE$ becomes equal to or more than the threshold value TH. Herein, the description will proceed assuming that the combustion state of the engine 10 has not deteriorated and that the rotation variation amount $\Delta NE$ is less than the threshold value TH. When the rotation variation amount $\Delta NE$ is less than the threshold value TH, the process proceeds to step S107.

Figure 4:
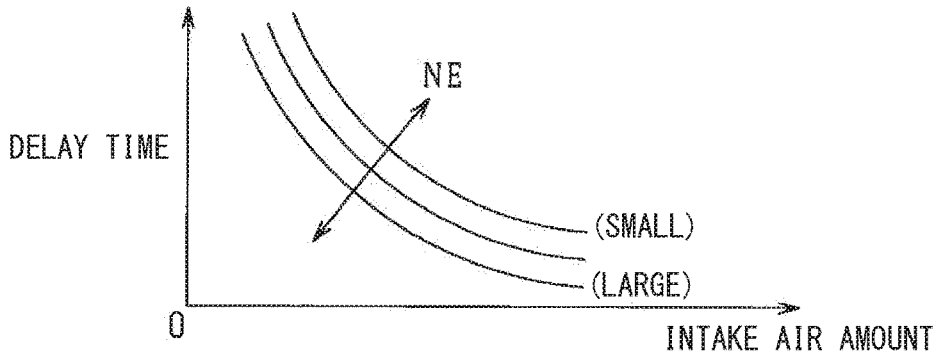
FIG. 4 is a diagram showing a relationship between an intake air flow rate, an engine rotation speed, and a delay time.

In step S107, the intake flow rate is detected based on the information from the airflow meter 13. In the subsequent step S108, a NOx concentration transportation delay conforming process is executed based on the intake air flow rate and the rotation speed NE. In the exhaust pipe 24, it takes time for exhaust gas emitted from the engine 10 to reach the NOx sensor 34. The delay becomes longer, as the intake flow rate becomes smaller and as the rotation speed NE becomes smaller. The microcomputer 41 computes a delay time of exhaust gas based on the intake flow rate and the rotation speed NE by using, for example, the relationship shown in FIG. 4. Then, the target NOx concentration is corrected in consideration of the delay time. In this case, a time constant of a first-order delay caused by the transportation of exhaust gas is switched according to the intake air flow rate. This enables to match the NOx concentration at the position of the NOx sensor 34 in the exhaust pipe 24 with the timing of combustion in the engine 10.

In the subsequent step S109, the actual NOx concentration is detected based on the information from the NOx sensor 34. Subsequently, in step S110, a NOx concentration deviation is calculated by subtracting the target NOx concentration from the actual NOx concentration (NOx concentration deviation=actual NOx concentration-target NOx concentration).

Subsequently, in step S111, the correction value Δλ of the target air-fuel ratio is calculated based on the NOx concentration deviation. In this case, the microcomputer 41 computes the correction value Δλ as a positive value when the NOx concentration deviation is a positive value, that is, when the actual NOx concentration is higher than the target NOx concentration. The microcomputer 41 computes the correction value Δλ as a negative value when the NOx concentration deviation is negative, that is, when the actual NO x concentration is lower than the target NO x concentration. The correction value Δλ is a correction amount added to the target air-fuel ratio. When the correction value Δλ is a positive value, the target air-fuel ratio is corrected such that the lean degree increases (that is, increasing correction is performed). Further, when the correction value Δλ is a negative value, the target air-fuel ratio is corrected such that the lean degree decreases (that is, decreasing correction is performed). It is noted that, the correction value Δλ may be calculated as a correction coefficient to be multiplied by the target air-fuel ratio.

Figure 5:
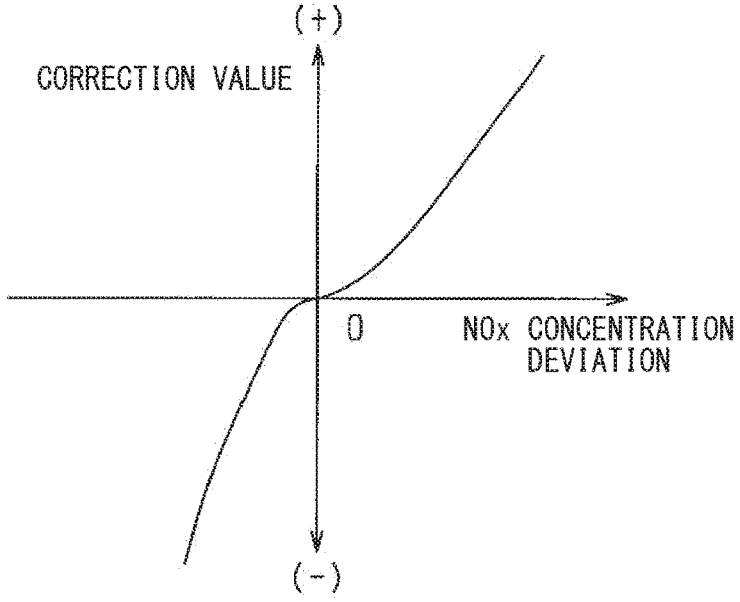
FIG. 5 is a diagram showing a relationship between a NOx concentration deviation and a target air-fuel ratio correction value.

The computation of the correction value Δλ will be described in more detail. In the present embodiment, the correction value Δλ is computed based on the NOx concentration deviation according to the relationship of FIG. 5. FIG. 5 defines a relationship in which as the NOx concentration deviation becomes large on the positive side, the correction value Δλ as computed becomes larger on the positive side, when the NOx concentration deviation is a positive value (actual NOx concentration>target NOx concentration). FIG. 5 defines a relationship in which as the NOx concentration deviation becomes large on the negative side, the correction value Δλ as computed becomes larger on the negative side, when the NOx concentration deviation is a negative value (actual NOx concentration<target NOx concentration).

In addition, in FIG. 5, a sensitivity of the correction is different between the correction value Δλ on the positive side and the correction value Δλ on the negative side. That is, the sensitivity of the correction is different between the correction on the side of increasing the lean degree of the target air-fuel ratio and the correction on the side of decreasing the lean degree. Specifically, the sensitivity of the correction on the side of decreasing the lean degree of the target air-fuel ratio is higher than the correction on the side of increasing the lean degree. Accordingly, the target air-fuel ratio is corrected with a larger correction gain, when the actual NOx concentration is lower than the target NOx concentration, compared to the case where the actual NOx concentration is higher than the target NOx concentration. The correction gain is a correction ratio for each NOx concentration deviation.

After the computation of the correction value Δλ, in step S112, the correction value Δλ is stored in the memory 43. The correction value Δλ may be stored as a learning value in the memory 43. Herein, in the memory 43, multiple operating regions are defined according to the engine operating state such as the engine speed and the engine load, and the correction value Δλ is stored for each operating region. It is noted that determination may be made which operating region is to be the storage destination of the correction value Δλ in consideration of the above-mentioned delay of exhaust gas. When the correction value Δλ is already stored in the target operating region, the past value may be overwritten (updated) with the current correction value Δλ while performing a smoothing process. The correction value Δλ may be sequentially updated while performing a moving average process.

When it is determined in step S106 described above that the rotation variation amount ΔNE is equal to or greater than the threshold value TH, the process proceeds to step S113. For example, when the lean degree becomes too large as the target air-fuel ratio is set to be leaner, it is concerned that the rotation variation of the engine 10 becomes excessive.

In step S113, a increasing process for the target NOx concentration is executed. That is, in step S113, in order to give priority to stabilizing of the combustion state rather than decreasing of the NOx concentration, the target NOx concentration is changed to the higher side. In this case, the NOx concentration deviation (=actual NOx concentration−target NOx concentration) becomes smaller or becomes larger on the negative side by increasing the target NOx concentration. Therefore, the correction value Δλ becomes smaller or becomes larger on the negative side. That is, in order to enhance the combustion stability, the target air-fuel ratio is corrected such that the lean degree is decreased. In the following step S114, the NOx concentration increasing flag F is set to 1.

When the NOx concentration increasing flag F is set to 1, a negative determination is made in step S103. Therefore, the process proceeds from step S103 to step S115 where determination is made whether or not a predetermined time has elapsed since the NOx concentration increasing flag F was set to 1. It is noted that, in step S115, determination whether a predetermined time has elapsed may be made after the rotation variation amount ΔNE becomes less than the threshold value TH subsequent to that the target NOx concentration is increased in step S113. When the predetermined time has not elapsed, step S115 makes a negative determination, and the process is once terminated. When the predetermined time has elapsed, step S115 makes an affirmative determination, and the process proceeds to step S116.

In step S116, a process is executed, as a target NOx concentration decreasing process, to gradually change the target NOx concentration toward a concentration before the change is made. In this case, as the target NOx concentration is lowered, the target air-fuel ratio becomes leaner correspondingly. Therefore, a concern arises that a rotation variation of the engine 10 may occur again. Therefore, in step S116, the lower limit of the target NOx concentration may be set based on the actual NOx concentration when the rotation variation amount ΔNE becomes greater than or equal to the threshold value TH (that is, when deterioration of the combustion state is determined). The decrease of the target NOx concentration may be regulated at the lower limit. The target NOx concentration is changed gradually while an amount of its change per unit time is limited.

In this embodiment, the actual NOx concentration, when the rotation variation amount ΔNE becomes greater than or equal to the threshold value TH, is set as the lower limit of the target NOx concentration. Alternatively, the actual NOx concentration, when the rotation variation amount ΔNE becomes greater than or equal to the threshold value TH, is set as a reference value, and a value on the higher concentration side or lower concentration side than the reference value may be set as the lower limit of the target NOx concentration.

Herein, a correction process of the target air-fuel ratio will be described with reference to FIG. 6. This correction process is executed by the microcomputer 41 on a regular basis.

Figure 6:
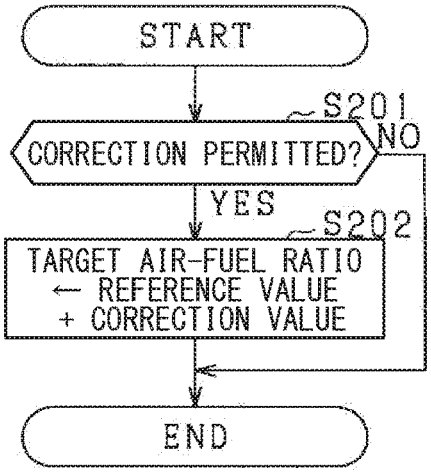
FIG. 6 is a flowchart showing a correction process of a target air-fuel ratio.

In FIG. 6, in step S201, determination is made whether or not the correction of the target air-fuel ratio by the correction value Δλ is permitted. Specifically, determination is made for each of the conditions (1) whether the engine combustion mode is the lean combustion mode and (2) whether a failure history (diagnosis information) is not stored for the exhaust system of the engine 10 is satisfied. When each of the conditions is satisfied, the process proceeds to step S202 where the target air-fuel ratio is corrected by adding the correction value Δλ to a reference value of the target air-fuel ratio. When each of the conditions is not satisfied, the target air-fuel ratio is not corrected, and the process ends.

The reference value of the target air-fuel ratio is an initial value when the correction of the target air-fuel ratio is performed. The reference value may be a lean air-fuel ratio that is a predetermined value. The reference value may be determined in consideration of the relationship shown in FIG. 2. For example, the reference value may be determined based on the range X in which both the NOx concentration and the combustion stability index COV are smaller than the allowable limit. In this case, it is conceivable that an intermediate value within the range X, a rich side limit value in the range X, a lean side limit value in the range X or the like is set as the reference value. Alternatively, the reference value may be set on the rich side (the side where the lean degree becomes smaller) than the rich side limit value of the range X or on the lean side (the side where the lean degree becomes larger) than the lean side limit value. For example, when priority is given to the combustion stability, the reference value of the target air-fuel ratio is set to a value on the rich side with respect to the rich side limit value of the range X. When priority is given to the decrease of the NOx concentration, the reference value of the target air-fuel ratio is set to a value on the lean side with respect to the lean side limit value of the range X.

When the correction value Δλ computed in the process of FIG. 3 is stored as a learning value in the memory 43, the correction value Δλ may be set as the reference value (initial value) of the target air-fuel ratio when the vehicle travels in the next occasion (next trip).

Figure 7:
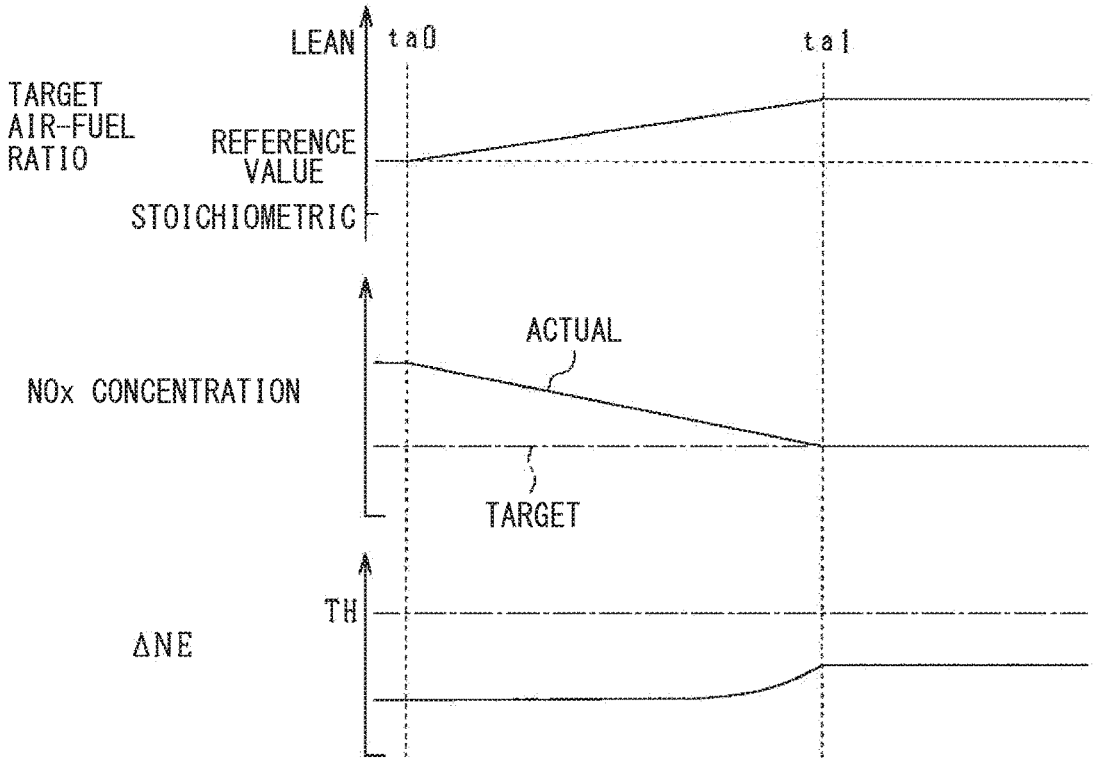
FIG. 7 is a time chart specifically showing a processing for correcting the target air-fuel ratio.
Figure 8:
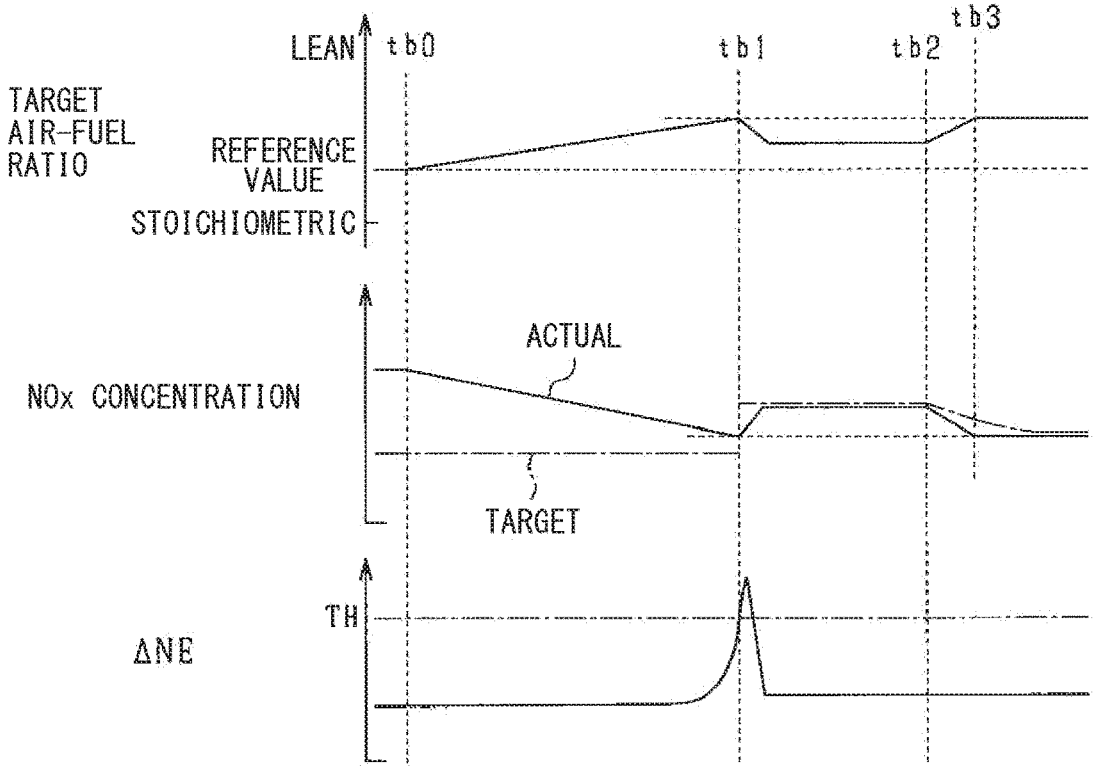
FIG. 8 is a time chart specifically showing a process for correcting the target air-fuel ratio.

Herein, a process to correct the target air-fuel ratio will be described more specifically with reference to FIGS. 7 and 8. FIG. 7 shows a case where excessive rotation variation does not occur in the illustrated period. FIG. 8 shows a case where excessive rotation variation occurs in the illustrated period. In FIGS. 7 and 8, the correction of the target air-fuel ratio based on the NOx concentration is started at the timings of ta0 and tb0.

In FIG. 7, at the timing of ta0, the reference value is set as the target air-fuel ratio. This reference value is, for example, a value on the rich side (on the side on which the lean degree becomes smaller) than the range X shown in FIG. 2. Subsequent to ta0, the target air-fuel ratio is corrected based on the NOx concentration deviation which is the deviation between the actual NOx concentration and the target NOx concentration.

In this case, the reference value of the target air-fuel ratio is a value on the rich side with respect to the range X, and therefore, the actual NOx concentration is high. The NOx concentration deviation is a positive value (that is, the actual NOx concentration>target NOx concentration), and therefore, the correction value Δλ becomes a positive value. The target air-fuel ratio is corrected such that the lean degree increases. Thus, as the lean degree of the target air-fuel ratio increases, the actual NOx concentration gradually decreases.

Subsequently, at the timing of ta1, the NOx concentration deviation becomes substantially zero, and the increasing correction of the target air-fuel ratio is completed. In FIG. 7, the target air-fuel ratio is corrected such that the lean degree increases, and therefore, the rotation variation amount ΔNE increases. However, its degree is small, and therefore, the rotation variation amount ΔNE is kept within an allowable limit.

Similarly to FIG. 7, in FIG. 8, at the timing of tb0, a reference value on the rich side with respect to the range X shown in FIG. 2 is set as the target air-fuel ratio. Subsequent to tb0, the target air-fuel ratio is corrected based on the NOx concentration deviation that is the deviation between the actual NOx concentration and the target NOx concentration. As a result, the target air-fuel ratio is corrected such that the lean degree increases, and the actual NOx concentration is gradually decreased.

Further, at the timing of tb1 in FIG. 8, rotation variation occurs in the engine 10, and the rotation variation amount ΔNE reaches the threshold value TH, before the NOx concentration deviation becomes zero, that is, before the correction of the target air-fuel ratio is completed. When the lean degree of the target air-fuel ratio is gradually increased, it is conceivable that the combustion state is disturbed earlier than expectation, and the rotational variation becomes excessively large. For example, in a case where the relationship between the air-fuel ratio and combustion stability (COV) deviates from its normal relationship due to a deviation in the intake air amount, a deviation in the machine difference of the engine, and the like, it is conceivable that an unintended rotation variation may occur at an unexpected target air-fuel ratio.

At the timing of tb1, the target NOx concentration is increased, and the target air-fuel ratio is corrected to the rich side (the side to decrease the lean degree) correspondingly. That is, at the timing of tb1, in the state where the target air-fuel ratio is corrected such that the lean degree increases, the target NOx concentration is increased on determination that the combustion state of the engine 10 has deteriorated. In this way, combustion stabilization is achieved. It is noted that, at the timing of tb1, instead of increasing the target NOx concentration, the target air-fuel ratio may be corrected to the rich side (the side to decrease the lean degree).

Subsequently, after the timing of tb1, the rotation variation amount ΔNE becomes less than the threshold value TH. At the timing of tb2 when a predetermined time has passed as in this state, the target NOx concentration is returned to be decreased. In this case, the lower limit of the target NOx concentration is set based on the actual NOx concentration when the rotation variation amount ΔNE reaches the threshold value TH (that is, the actual NOx concentration at tb1). Decreasing of the target NOx concentration is regulated at the lower limit value (timing at tb3). In this way, even in a case where the target NOx concentration is lowered again, occurrence of the rotation variation in the engine 10 due to this can be restricted.

According to this embodiment described in detail up to this point, the following effects may be expected.

When it is determined that the lean combustion is being performed, the target air-fuel ratio is corrected based on the target NOx concentration and the actual NOx concentration. In this way, the air-fuel ratio control can be appropriately performed to stabilize the combustion while optimizing NOx emission amount from the engine 10.

When the actual NOx concentration is higher than the target NOx concentration, the correction value Δλ is set to a positive value, and the target air-fuel ratio is corrected such that the lean degree becomes larger. When the actual NOx concentration is lower than the target NOx concentration, the correction value Δλ is set to a negative value, and the target air-fuel ratio is corrected such that the lean degree becomes smaller. This configuration enables to perform an air-fuel ratio control appropriately in consideration of the relationship among the air-fuel ratio, the NOx concentration, and the combustion stability. Further, the configuration enables to control the lean degree of the target air-fuel ratio with high accuracy, as compared with a configuration that controls the lean degree of the target air-fuel ratio based on the rotation variation of the engine 10.

When the actual NOx concentration is lower than the target NOx concentration (that is, when the lean degree of the target air-fuel ratio is to be decreased), the target air-fuel ratio is corrected with the correction gain larger than the correction gain in a case where the actual NOx concentration is higher than the target NOx concentration (that is, when the lean degree of the target air-fuel ratio is to be increased). Herein, when the actual NOx concentration is lower than the target NOx concentration, it is conceivable that the NOx concentration is excessively low and that the combustion state of the engine 10 becomes unstable. Therefore, in such a state, the correction gain of the target air-fuel ratio is increased such that the unstable combustion state can be quickly addressed. When the actual NOx concentration is higher than the target NOx concentration, the configuration enables to restrict occurrence of hunting while suppressing unintended deterioration of the combustion state.

In the lean range of the air-fuel ratio, the reference value of the target air-fuel ratio is set on the rich side with resect to the rich side limit value of the air-fuel ratio. The target air-fuel ratio is corrected based on the NOx concentration by using that reference value as the initial value of the target air-fuel ratio. Therefore, the configuration enables to optimize the target air-fuel ratio, that is, to optimize the air-fuel ratio control, while giving priority to ensuring of the combustion stability of the engine 10.

The target NOx concentration is increased, when it is determined that the combustion state of the engine 10 has deteriorated, in the state where the target air-fuel ratio is corrected such that the lean degree is increased. In this way, in the process to increase the lean degree of the target air-fuel ratio, even when the combustion state deteriorates earlier than intended, the configuration enables to deal the deterioration of the combustion state appropriately.

After the deterioration of the combustion state has been addressed by increasing the target NOx concentration, the configuration gradually changes the target NOx concentration to the concentration before the change. In this way, a sudden change in the combustion state can be suppressed.

In the case where the target NOx concentration is increased correspondingly to the deterioration of the combustion state, and subsequently, the target NOx concentration is decreased again, the lower limit value of the target NOx concentration is set based on the actual NOx concentration that is a value when the deterioration of the combustion state is determined. In this way, the configuration enables to preferably suppress deterioration of the combustion state again due to the decrease in the target NOx concentration, after the deterioration of the combustion state occurs.

During the transient operation, the NOx emission amount from the engine 10 is not stable. In this respect, when it is determined that the engine 10 is in the transient operation, the correction of the target air-fuel ratio is not performed. Therefore, the configuration enables to restrict disturbance of the air-fuel ratio control.

The target air-fuel ratio is corrected in consideration of the delay from combustion of exhaust gas in the engine 10 until the exhaust gas reaches the NOx concentration detection unit. In this way, the configuration enables to perform appropriate air-fuel ratio control while matching the phase of the target NOx concentration with the phase of the actual NOx concentration.

In the engine 10, the state of deterioration of combustion and the state of NOx emission are different for each operating region. In this respect, the multiple engine operating regions are assigned, and the correction value Δλ is stored for each of the operating regions. Therefore, the configuration enables to suitably optimize the air-fuel ratio control in each of the operating regions of the engine.

Other Embodiments

In the above embodiment, the configuration once increases the target NOx concentration, in response to that the rotation variation amount ΔNE exceeds the threshold value TH. Subsequently, when the target NOx concentration is decreased again, the configuration sets the lower limit of the target NOx concentration based on the actual NOx concentration that is a value when the rotation variation amount ΔNE becomes greater than or equal to the threshold value TH. It is noted that, this configuration may be modified. That is, the lean upper limit of the target air-fuel ratio may be set based on the target air-fuel ratio that is a value when the rotation variation amount ΔNE becomes greater than or equal to the threshold value TH. In this case, the target NOx concentration is gradually decreased while the upper limit guard is applied to the target air-fuel ratio. In the process of FIG. 3, in step S116, the decrease of the target NOx concentration may be limited by a lean upper limit value of the target air-fuel ratio that is set based on the target air-fuel ratio that is a value when the rotation variation amount ΔNE becomes greater than or equal to the threshold value TH. In addition, the target air-fuel ratio when the rotation variation amount ΔNE becomes greater than or equal to the threshold value TH may be set as a reference value. In this case, a value on the lean side of the reference value or a value on the rich side of the reference value may be set as a lean upper limit value of the target air-fuel ratio. This configuration enables to suitably suppress deterioration of the combustion state caused again by shifting the target air-fuel ratio to the lean side, after deterioration of the combustion state occurs.

In the above embodiment, when the actual NOx concentration is lower than the target NOx concentration, the configuration corrects the target air-fuel ratio with a larger correction gain than that when the actual NOx concentration is higher than the target NOx concentration. It is noted that, this configuration may be modified. For example, contrary to the above, when the actual NOx concentration is lower than the target NOx concentration, a configuration may be employed to correct the target air-fuel ratio with a smaller correction gain than that when the actual NOx concentration is higher than the target NOx concentration. The correction gain may be the same in these cases.

In the above embodiment, the NOx sensor 34 is provided on the downstream side of the three-way catalyst 31 in the exhaust passage. It is noted that, the NOx sensor 34 may be provided to the upstream side of the three-way catalyst 31. Further, a NOx sensor may be added on the downstream side of the NOx catalyst 33, and the state of the NOx catalyst 33 may be monitored by using the NOx sensor and the NOx sensor 34.

Although the present disclosure has been described in accordance with the examples, it is understood that the present disclosure is not limited to such examples or structures. The present disclosure encompasses various modifications and variations within the scope of equivalents. In addition, various combinations and configurations, as well as other combinations and configurations that include only one element, more, or less, fall within the scope and spirit of the present disclosure.

What is claimed is:

1. An air-fuel ratio control device configured to set a target air-fuel ratio and to perform an air-fuel ratio control based on the target air-fuel ratio for an engine of spark ignition type, the air-fuel ratio control device comprising:

a lean combustion determination unit configured to determine whether lean combustion is performed in the engine based on a target air-fuel ratio, the target air-fuel ratio being set on a lean side of a theoretical air-fuel ratio;

a target NOx setting unit configured to set a target NOx concentration according to an operating state of the engine;

an acquisition unit configured to acquire an actual NOx concentration detected by using a NOx concentration detection unit in the exhaust passage of the engine;

a calculation unit configured to calculate a deviation between the target NOx concentration and the actual NOx concentration; and a correction unit configured to correct the target air-fuel ratio based on the deviation between the target NOx concentration and the actual NOx concentration, when determination is made that the lean combustion is performed.

2. The air-fuel ratio control device according to claim 1, wherein the correction unit is configured to correct the target air-fuel ratio such that a lean degree increases when the actual NOx concentration is higher than the target NOx concentration and to correct the target air-fuel ratio such that the lean degree decreases when the actual NOx concentration is lower than the target NOx concentration.

3. The air-fuel ratio control device according to claim 2, wherein the correction unit is configured to correct the target air-fuel ratio with a correction gain when the actual NOx concentration is lower than the target NOx concentration, and the correction gain is larger than a correction gain when the actual NOx concentration is higher than the target NOx concentration.

4. The air-fuel ratio control device according to claim 1, wherein a reference value of the target air-fuel ratio is set to a rich side limit value of the air-fuel ratio, which is defined by a NOx allowable limit that is in a lean region of the air-fuel ratio in a relationship between the air-fuel ratio and the NOx concentration or to a value on a rich side of the rich side limit value, the correction unit is configured to correct the target air-fuel ratio by using the reference value as an initial value of the target air-fuel ratio.

5. The air-fuel ratio control device according to claim 1, further comprising:

a combustion state determination unit configured to determine whether a combustion state in the engine is deteriorated in a state where the correction unit corrects the target air-fuel ratio such that a lean degree increases; and a NOx concentration changing unit configured to increase the target NOx concentration when determination is made that the combustion state is deteriorated.

6. The air-fuel ratio control device according to claim 5, wherein the NOx concentration changing unit is configured to gradually change the target NOx concentration to a concentration before changing, after the deterioration of the combustion state has been addressed by increasing of the target NOx concentration.

7. The air-fuel ratio control device according to claim 5, wherein the lower limit of the target NOx concentration is set based on the actual NOx concentration that is a value when determination is made that the combustion state is deteriorated, in a case where the NOx concentration changing unit increases the target NOx concentration correspondingly to deterioration of the combustion state.

8. The air-fuel ratio control device according to claim 5, wherein a lean upper limit of the target air-fuel ratio is set based on the target air-fuel ratio that is a value when determination is made that the combustion state is deteriorated in a case where the NOx concentration changing unit increases the target NOx concentration correspondingly to deterioration of the combustion state.

9. The air-fuel ratio control device according to claim 1, further comprising:

a transient operation determining unit configured to determine whether the engine is in a transient operation, wherein the correction unit is configured not to correct the target air-fuel ratio when the transient operation determination unit determines that the transient operation is in progress.

10. The air-fuel ratio control device according to claim 1, wherein the correction unit is configured to correct the target air-fuel ratio in consideration of a delay after combustion in the engine until exhaust gas reaches the NOx concentration detector.

11. The air-fuel ratio control device according to claim 1, further comprising:

a rotation variation amount acquisition unit configured to acquire a rotation variation amount of the engine; and a combustion state determination unit configured to determine whether a combustion state in the engine is deteriorated based on the rotation variation amount.

12. An air-fuel ratio control device configured to set a target air-fuel ratio and to perform an air-fuel ratio control based on the target air-fuel ratio for an engine of spark ignition type, the air-fuel ratio control device comprising:

a lean combustion determination unit configured to determine whether lean combustion is performed in the engine based on a target air-fuel ratio, the target air-fuel ratio being set on a lean side of a theoretical air-fuel ratio;

a target NOx setting unit configured to set a target NOx concentration according to an operating state of the engine;

an acquisition unit configured to acquire an actual NOx concentration detected by using a NOx concentration detection unit in the exhaust passage of the engine; and a correction unit configured to correct the target air-fuel ratio based on the target NOx concentration and the actual NOx concentration, when determination is made that the lean combustion is performed, wherein the correction unit is configured to correct the target air-fuel ratio such that a lean degree increases when the actual NOx concentration is higher than the target NOx concentration and to correct the target air-fuel ratio such that the lean degree decreases when the actual NOx concentration is lower than the target NOx concentration.

13. The air-fuel ratio control device according to claim 12, wherein the correction unit is configured to correct the target air-fuel ratio with a correction gain when the actual NOx concentration is lower than the target NOx concentration, and the correction gain is larger than a correction gain when the actual NOx concentration is higher than the target NOx concentration.

14. The air-fuel ratio control device according to claim 12, wherein a reference value of the target air-fuel ratio is set to a rich side limit value of the air-fuel ratio, which is defined by a NOx allowable limit that is in a lean region of the air-fuel ratio in a relationship between the air-fuel ratio and the NOx concentration or to a value on a rich side of the rich side limit value, the correction unit is configured to correct the target air-fuel ratio by using the reference value as an initial value of the target air-fuel ratio.

15. The air-fuel ratio control device according to claim 12, further comprising:

a combustion state determination unit configured to determine whether a combustion state in the engine is deteriorated in a state where the correction unit corrects the target air-fuel ratio such that a lean degree increases; and a NOx concentration changing unit configured to increase the target NOx concentration when determination is made that the combustion state is deteriorated.

16. The air-fuel ratio control device according to claim 15, wherein the NOx concentration changing unit is configured to gradually change the target NOx concentration to a concentration before changing, after the deterioration of the combustion state has been addressed by increasing of the target NOx concentration.

17. The air-fuel ratio control device according to claim 15, wherein the lower limit of the target NOx concentration is set based on the actual NOx concentration that is a value when determination is made that the combustion state is deteriorated, in a case where the NOx concentration changing unit increases the target NOx concentration correspondingly to deterioration of the combustion state.

18. The air-fuel ratio control device according to claim 15, wherein a lean upper limit of the target air-fuel ratio is set based on the target air-fuel ratio that is a value when determination is made that the combustion state is deteriorated in a case where the NOx concentration changing unit increases the target NOx concentration correspondingly to deterioration of the combustion state.

19. The air-fuel ratio control device according to claim 12, wherein the correction unit is configured to correct the target air-fuel ratio in consideration of a delay after combustion in the engine until exhaust gas reaches the NOx concentration detector.

20. The air-fuel ratio control device according to claim 12, further comprising:

a rotation variation amount acquisition unit configured to acquire a rotation variation amount of the engine; and a combustion state determination unit configured to determine whether a combustion state in the engine is deteriorated based on the rotation variation amount.

* * * * *